United States Patent [19]

Masaki

[11] 4,407,247

[45] Oct. 4, 1983

[54] CLOSED LOOP TYPE AIR-FUEL RATIO CONTROL SYSTEM OF AN INTERNAL COMBUSTION ENGINE

[75] Inventor: Kenji Masaki, Yokohama, Japan

[73] Assignee: Nissan Motor Co., Ltd., Yokohama, Japan

[21] Appl. No.: 313,630

[22] Filed: Oct. 21, 1981

[30] Foreign Application Priority Data

Oct. 22, 1980 [JP] Japan ..... 55-147731

[51] Int. Cl.[3] ..... F02B 3/00

[52] U.S. Cl. ..... 123/438; 123/440

[58] Field of Search ..... 123/437, 438, 439, 440, 123/489

[56] References Cited

U.S. PATENT DOCUMENTS

| | | | |
|---|---|---|---|
| 4,050,428 | 9/1977 | Masaki | 123/438 |
| 4,057,042 | 11/1977 | Aono | 123/438 |
| 4,106,464 | 8/1978 | Yamashita et al. | 123/437 |
| 4,192,140 | 3/1980 | Yamashita et al. | 123/438 |
| 4,282,840 | 8/1981 | Yamada et al. | 123/438 |
| 4,341,190 | 7/1982 | Ishikawa et al. | 123/440 |

FOREIGN PATENT DOCUMENTS 54-155311 12/1979 Japan ..... 123/440

*Primary Examiner*—Parshotam S. Lall

*Attorney, Agent, or Firm*—Lowe, King, Price & Becker

[57] ABSTRACT

In an internal combustion engine having at its intake section a two-barrel type carburetor including a primary fuel supply system having a primary main fuel supply line and a primary slow fuel supply line and a secondary fuel supply system having a secondary main fuel supply line and a secondary step fuel supply line, and at its exhaust section a three-way catalytic converter, there is provided an improved closed loop type air-fuel ratio control system which controls not only the amount of air fed to the primary main and slow fuel supply lines but also the amount of air fed to the secondary main and step fuel supply lines in accordance with the concentration of a selected component of the engine exhaust gas. A switching valve is associated with both the primary slow fuel supply line and the secondary main or step fuel supply line so as to alter the course of the air introduction into the primary slow fuel supply line or into the secondary main or step fuel supply line in accordance with the engine load.

6 Claims, 3 Drawing Figures

CONTROL CIRCUIT
FROM 26
FROM 74
FROM 108
TO 106
TO 106
TO 106
ML
ML'
SL
SL'

CLOSED LOOP TYPE AIR-FUEL RATIO CONTROL SYSTEM OF AN INTERNAL COMBUSTION ENGINE

BACKGROUND OF THE INVENTION

1. Field of the Invention

The present invention relates to a closed loop type air-fuel ratio control system of an internal combustion engine, which controls the air-fuel ratio of the engine inlet mixture to a desired value in accordance with the concentration of a selected component of the exhaust gas from the engine.

2. Description of the Prior Art

In order to reduce the harmful compounds, such as HC, CO and $NO_x$, contained in the exhaust gas from the internal combustion engine, a so-called three-way catalytic converter is widely used. In this connection, it is known that the three-way catalytic converter exhibits its maximum function against those three harmful compounds when the air-fuel mixture to be fed into the engine has a stoichiometric air-fuel ratio. In case of gasoline powered internal combustion engine, the stoichiometric air-fuel ratio is about 14.7:1.

As a system which puts the above-mentioned fact into a practical use, a closed loop type air-fuel ratio control system has been employed in the engine system, which generally comprises an electrically controlled carburetor arranged in an intake line of the engine, an exhaust gas sensor (such as an oxygen sensor) arranged in the exhaust line of the engine at a position upstream of the converter for issuing an information signal representative of the air-fuel ratio of the inlet mixture actually fed into the engine proper, and a control unit electrically connecting to both the carburetor and the sensor for controlling the operation of the carburetor in accordance with the information signal issued from the sensor. However, some of the control systems of this type fail to exhibit the precise function throughout the whole operation modes of the engine, as will become clear hereinafter.

BRIEF SUMMARY OF THE INVENTION

It is thus an essential object of the present invention to provide a closed loop type air-fuel ratio control system which exhibits its feedback controlling function precisely throughout the whole modes of the engine.

According to the present invention, there is provided, in an internal combustion engine having at its intake section a two-barrel type carburetor including a primary fuel supply system having a primary main fuel supply line and a primary slow fuel supply line and a secondary fuel supply system having a secondary main fuel supply line and a secondary step fuel supply line, and at its exhaust section a three-way catalytic converter disposed in an exhaust tube of the engine, a closed loop type air-fuel ratio control system which comprises an exhaust gas sensor for producing an information signal representative of the air-fuel ratio of the engine inlet mixture by measuring the engine exhaust gas, a control unit for producing a command signal by processing the information signal issued from the exhaust gas sensor, first means for controlling the amount of air fed to the primary main fuel supply line in accordance with the command signal from the control unit, second means having first and second conditions which take place selectively, the first condition being a condition wherein the second means controls the amount of air fed to the primary slow fuel supply line in accordance with the command signal from the control unit, the second condition being a condition wherein the second means controls the amount of air fed to either of the secondary main fuel supply line and the secondary step fuel supply line in accordance with the command signal from the control unit, and third means for causing the second means to assume selectively the first and second conditions in accordance with the load applied to the engine.

BRIEF DESCRIPTION OF THE DRAWINGS

Other objects and advantages of the present invention will become clear from the following description when taken in conjunction with the accompanying drawings, in which.

DESCRIPTION OF THE INVENTION

Figure 1:
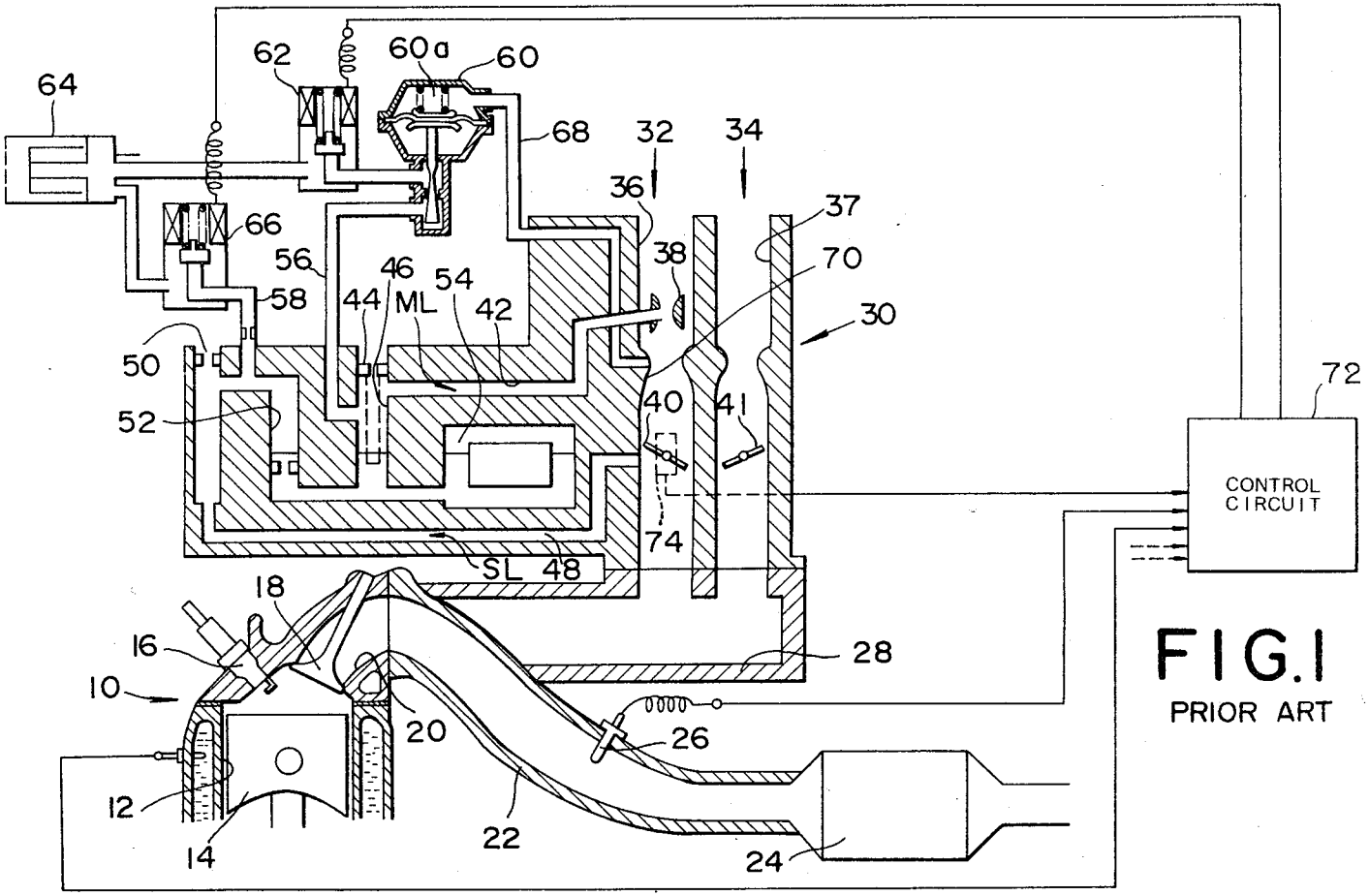
FIG. 1 PRIOR ART
FIG. 1 is a schematic illustration showing a conventional closed loop type air-fuel mixture control system.

Prior to describing the invention, a conventional closed loop type air-fuel ratio control system will be described with reference to FIG. 1 in order to clarify the invention.

In the drawing, there is shown an internal combustion engine incorporating therein the conventional closed loop type air-fuel ratio control system.

The engine comprises an engine proper 10 having cylinders 12, pistons 14, spark plugs 16, intake valves (no numerals) and exhaust valves 18 which are arranged in a conventional manner. Connected to exhaust ports 20 of the engine proper 10 through an exhaust manifold (no numeral) is an exhaust tube 22 which has at its downstream section a three-way catalytic converter 24 disposed therein. An exhaust gas sensor 26, such as an oxygen sensor, is disposed in the exhaust tube 22 at a position upstream of the converter 24.

Connected to intake ports (no numerals) of the engine proper 10 through an intake manifold 28 is a two-barrel type carburetor 30 which generally comprises a primary fuel supply system 32 and a secondary fuel supply system 34. In this conventional control system, the feedback control is directed toward only the operation of the primary fuel supply system 32 as will become clear as the description proceeds.

The primary fuel supply system 32 comprises a primary barrel 36, a small venturi 38, a primary throttle valve 40, a main fuel line ML including a main fuel passage 42, a main air bleed 44 and a main air mixing chamber 46, and a slow fuel line SL including a slow fuel passage 48, a slow air bleed 50 and a slow air mixing chamber 52, in such an arrangement as shown. Designated by numeral 54 is a float chamber to which the main fuel line ML and the slow fuel line SL are connected in a conventional manner.

A first auxiliary passage 56 extends from the main air mixing chamber 46, and a second auxiliary passage 58 extends from the slow air mixing chamber 52. The first auxiliary passage 56 leads through a vacuum operated air flow rate controller 60 and an electromagnetic valve 62 to an air filter 64. The second auxiliary passage 58 is connected to the air filter 64 through another electromagnetic valve 66. With the presence of the air filter 64, air to be fed into the passages 56 and 58 is cleaned. The vacuum chamber 60*a* of the air flow rate controller 60 is connected through a passage 68 to a large venturi portion 70 of the primary barrel 36 so that the effective sectional area of the passage 56 is decreased with increase of the amount of air passing through the primary barrel 36. Both the electromagnetic valves 62 and 66 are controlled by a control unit 72 which receives information signals from the exhaust gas sensor 26 and a primary throttle switch 74 which senses the opening angle of the primary throttle valve 40. The control unit 72 is so designed that when the exhaust gas sensor 26 issues a signal representing a richer condition of the air-fuel mixture in the intake system, the unit 72 operates the electromagnetic valves 62 and 66 to increase air flow in both the first and second auxiliary passages 56 and 58 thereby diluting the air-contained fuel flowing through the main and slow fuel supply lines ML and SL, and when the sensor 26 issues a signal representing a leaner condition of the air-fuel mixture in the intake system, the control unit 72 operates the valves 62 and 66 to decrease air flow in both the first and second auxiliary passages 56 and 58 thereby concentrating the air-contained fuel flowing through the main and slow fuel supply lines ML and SL. The arrangement is so made that when the electromagnetic valves 62 and 66 assume their close positions, the air-fuel mixture fed to the engine proper 10 becomes richer than stoichiometric, but when these valves 62 and 66 assume their open positions, the air-fuel mixture becomes leaner than stoichiometric. The control unit 72 issues command pulses of about 40 Hz for causing the valves 62 and 66 to make rapid open-close repeating operations. Actually, depending on the information signals from the exhaust gas sensor 26, the duty ratio of the commond signals varies to control the totally open time of the valves 62 and 66 thereby to direct the air-fuel ratio of the engine inlet mixture to the stoichiometric value. The air flow rate controller 60 functions to compensate the deviation of the air-fuel ratio of the inlet mixture fed to the engine proper 10.

In the following, a drawback encountered in the above-mentioned conventional closed loop type air-fuel ratio control system will be described.

As is understood from the above-description, in the conventional system, the feedback control is directed toward only the operation of the primary fuel supply system 32. This idea is based on a fact that the air pollulation problem caused by motor vehicles is mainly caused by urban area cruising of the vehicles wherein the primary fuel supply system 32 of the carburetor 30 operates substantially exclusively as compared with the secondary fuel supply system 34. In fact, even under a condition wherein the secondary throttle valve 41 slightly opens (under this condition, the primary throttle valve 40 is kept open largely), the stoichiometric control directed to the air-fuel mixture fed to the engine 10 is almost achieved.

However, usually, the secondary fuel supply system 34 is so designed as to produce an air-fuel mixture considerably richer than stoichiometric, for the purpose of gaining a power of the engine. Thus, when the secondary throttle valve 41 opens large thereby increasing the fuel supply duty of the secondary fuel supply system 34 relative to the primary system 32, the stoichiometric control to the air-fuel mixture fed to the engine proper is no longer achieved because of the obstruction of the air-fuel mixture produced by the secondary fuel supply system 34. This means that the air-fuel mixture to be fed into the engine 10 is richer than stoichiometric when the engine is under medium or high load operation. Thus, the engine is forced to produce an exhaust gas containing great amounts of HC and CO which are beyond the boundary of the effective working of the catalytic converter 24. This undesirable phenomenon becomes more critical when the vehicle cruises at high ground where air density is low, and when the vehicle is equipped with an unbalancedly small engine.

To solve the above-mentioned problem, the present invention is proposed.

Figure 2:
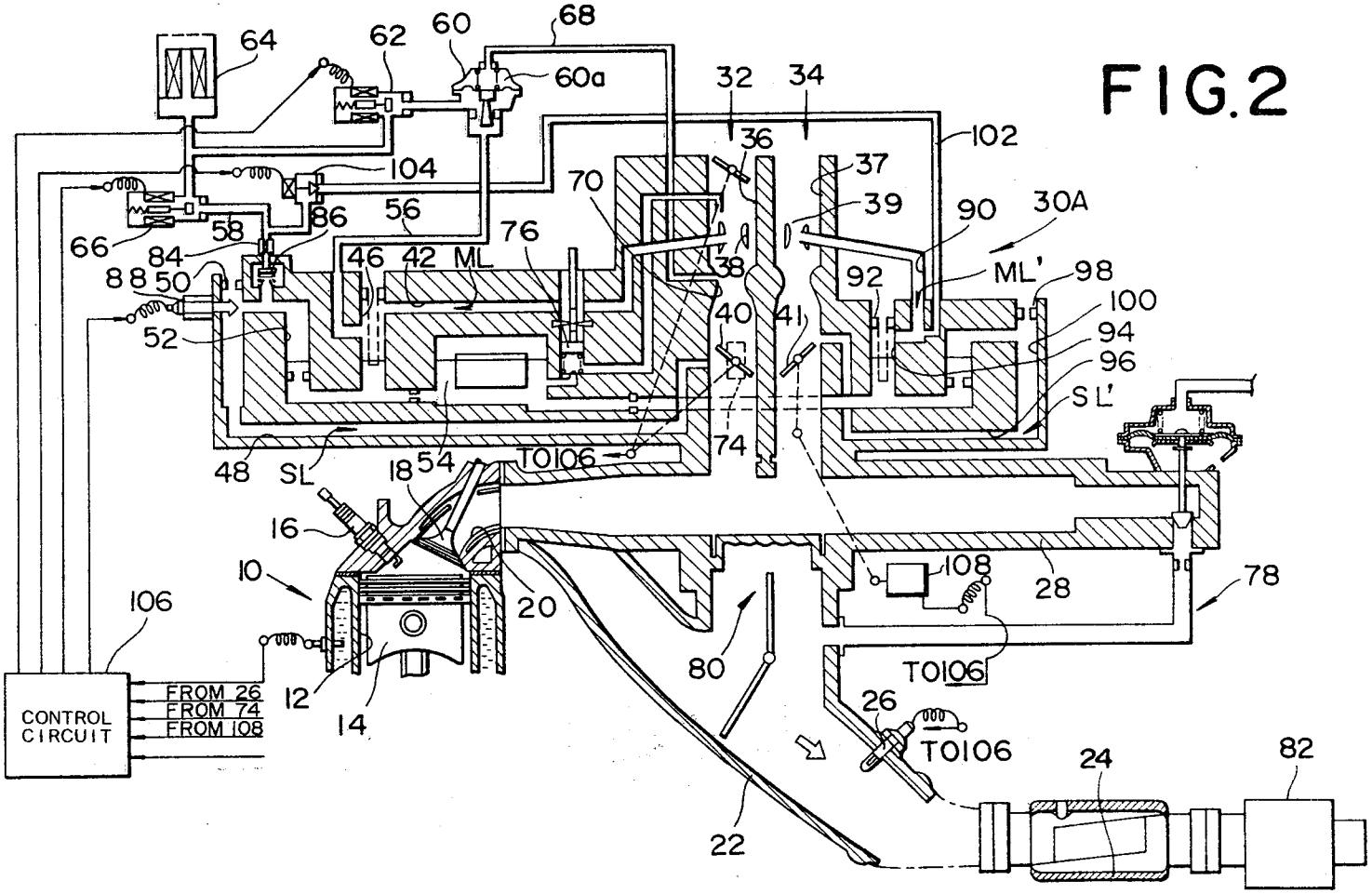
FIG. 2 is a schematic illustration showing a first embodiment of the closed loop type air-fuel ratio control system of the present invention.

Referring to FIG. 2, there is shown an internal combustion engine incorporating therein a closed loop type air-fuel ratio control system, of a first embodiment, according to the present invention. In the drawing, substantially the same parts and constructions as those in FIG. 1 are designated by the same numerals, and detailed explanation of them is omitted from the following for ease of description. The engine shown in FIG. 2 is illustrated to have an acceleration pump 76 in the carburetor 30A, an exhaust gas recirculation system 78, and an inlet mixture heating system 80, which are conventional devices. Designated by numeral 82 is a muffler which is arranged downstream of the three-way catalystic converter 24.

Similar to the conventional control system of FIG. 1, a first auxiliary passage 56 extends from the air mixing chamber 46 of the main fuel supply line ML to an air filter 64 through a vacuum operated air flow rate controller 60 and an electromagnetic valve 62. A second auxiliary passage 58 extends from the air mixing chamber 52 of the slow fuel supply line SL to the air filter 64 through another electromagnetic valve 66. An orifice 84 is disposed in the second auxiliary passage 58. A reverse flow inhibiting valve 86 is mounted at a position where the passage 58 is connected to the air mixing chamber 52, which permits introduction of air into the mixing chamber 52 while blocking escaping of fuel toward the passage 58. An electrically operated flow cut valve 88 is mounted in the slow fuel passage 48, which is constructed so that when electrically energized, it shuts the slow fuel passage 48 while permitting air introduction into the passage 48 from the slow air bleed 50.

The secondary fuel supply system 34 of the carburetor 30A of this embodiment comprises a small venturi 39, a main fuel supply line ML' including a main fuel passage 90, a main air bleed 92 and a main air mixing chamber 94, and a step fuel supply line SL' including a step fuel passage 96, a step air bleed 98 and a step air mixing chamber 100.

A third auxiliary passage 102 extends from the air mixing chamber 94 of the main fuel supply line ML'. The passage 102 is connected through an electromagnetic valve 104 to the second auxiliary passage 58 at a position upstream of the orifice 84. The valve 104 and the above-mentioned slow cut valve 88 are controlled by a control unit 106. A secondary throttle switch 108 is mechanically connected to the secondary throttle valve 41 in the secondary barrel 37, which issues a signal when the secondary throttle valve 41 opens beyond a predetermined degree, the signal being received by the control unit 106.

Operation will be described in the following.

When the engine is under a low load operation, such as under idling, only the primary fuel supply system 32 operates. In this condition, the primary throttle switch 74 senses full close condition of the primary throttle valve 40 allowing, via the control unit 106, the valves 62 and 104 to be kept in their close positions and the valve 66 to make the open-close repeating operation. Thus, in this condition, the first auxiliary passage 56 does not participate in feeding air into the main fuel supply line ML, but the second auxiliary passage 58 feeds air to the slow fuel supply line SL so that only this slow fuel line SL is subjected to a feedback control in accordance with the concentration of the selected component in the exhaust gas from the engine.

When the primary throttle valve 40 starts to open for producing a power, the main fuel supply line ML starts to feed the air-contained fuel to the primary barrel 36 of the carburetor 30A. When the primary throttle valve 40 now opens beyond a predetermined degree, the primary throttle switch 74 issues a signal allowing, via the control unit 106, the valve 62 to make the open-close repeating operation, permitting air introduction through the first auxiliary passage 56 ino the main fuel supply line ML. Thus, in this condition, not only the slow fuel supply line SL but also the main fuel supply line ML is subjected to the feedback control in accordance with the concentration of the selected component of the exhaust gas from the engine.

When the primary throttle valve 40 opens to such a degree as to induce initial opening operation of the secondary throttle valve 41, the secondary throttle switch 108 issues a signal allowing, via the control unit 106, the slow cut valve 88 to assume its close position shutting the slow fuel passage 48, and the valve 104 to assume its open position. Thus, under this condition, the fuel supply by the slow fuel supply line SL is inhibited, and only air from the slow air bleed 50 is fed to the primary barrel 36 through the slow fuel passage 48. The open condition of the valve 104 induces a connection between the third auxiliary passage 102 and the second auxiliary passage 58, so that a suitable amount of air from the air filter 64 is fed through the passages 58 and 102 into the air mixing chamber 94 of the main fuel line ML', of the secondary fuel supply system 34 depending on the open-close repeating operation of the valve 66 which is controlled by the control unit 106. Thus, when the engine is under a medium or high load condition, the valves 62 and 66 participate in controlling the air-fuel mixture in the primary and secondary barrels 36 and 37 to have a stoichiometric ratio, respectively.

When the primary throttle valve 40 takes its full open position for producing the maximum engine power, the primary throttle switch 74 issues a signal allowing, via the control unit 106, the valves 62 and 66 to be kept in their close positions. Thus, no additional air is fed to either the primary and secondary fuel supply systems 32 and 34 thereby causing the carburetor 30A to produce a richer air-fuel mixture.

As is understood from the above, when the secondary throttle valve 41 is under practical operation, the feedback control of the slow fuel supply line SL stops and the main fuel supply line ML' of the secondary fuel supply system 34 is subjected to the feedback control by the aid of the operation of the valve 66 which is a part of the slow fuel supply line SL of the primary fuel supply system 32.

Figure 3:
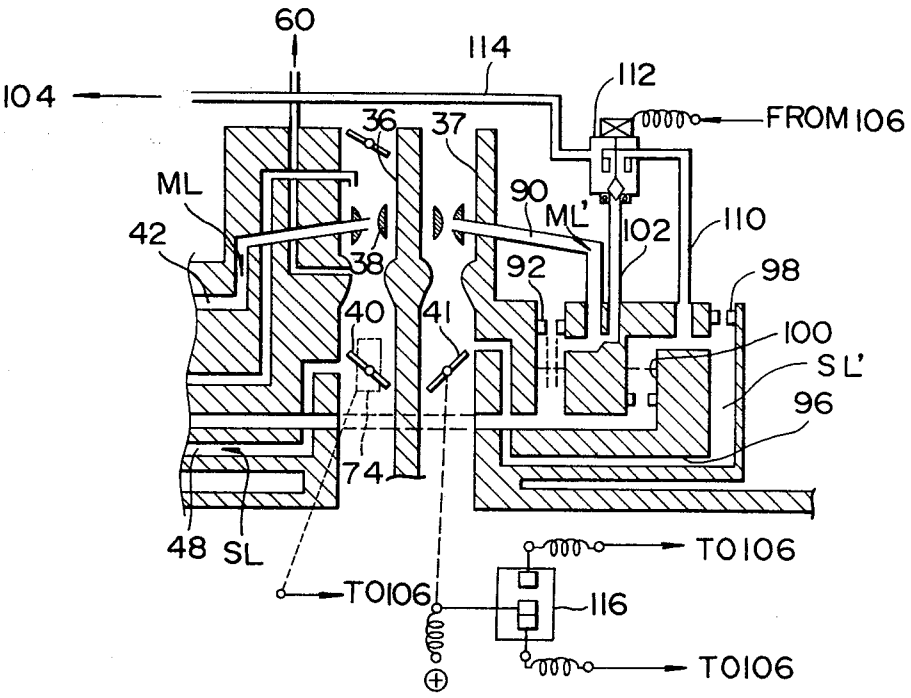
FIG. 3 is a partial and schematic illustration of a second embodiment of the present invention.

Referring to FIG. 3 of the drawings, there is shown a second embodiment of the present invention, which is a modification of the first embodiment. As will become clear from the following, in the second embodiment, the step fuel supply line SL' is also subjected to the feedback control.

A fourth auxiliary passage 110 extends from the air mixing chamber 100 of the step fuel supply line SL'. The passage 110 is connected to the third auxiliary passage 102 through an electromagnetic two-way valve 112 from which a passage 114 extends to the valve 104 (see FIG. 2). The two-way valve 112 is so designed as to selectively connect the passage 114 with the third auxiliary passage 102 and the fourth auxiliary passage 110 in response to energization and deenergization thereof. A secondary throttle switch 116 is mechanically connected to the secondary throttle valve 41 so that the switch 116 issues a first signal when the secondary throttle valve 41 starts to open, and a second signal when the valve 41 opens beyond a predetermined degree which induces an initial practical fuel feeding operation of the main fuel supply line ML' of the secondary fuel supply system 34. These signals are received in the control unit 106 (see FIG. 2).

When the secondary throttle valve 41 starts to open following considerable opening of the primary throttle valve 40, the secondary throttle switch 116 issues the first signal for permitting, via the control unit 106, the valve 104 to assume its open position, and the slow cut valve 88 to assume its close position. Thus, the passage 114 connects with the second auxiliary passage 58. Further, at the same time, the two-way valve 112 is caused to take the illustrated position, connecting the passage 114 with the fourth auxiliary passage 110. Accordingly, a suitable amount of air from the air filter 64 is fed into the step fuel supply line SL' depending on the open-close repeating operation of the valve 66, so that the step fuel supply line SL' is subjected to feedback control depending on the concentration of the selected component in the exhaust gas from the engine.

When the secondary throttle valve 41 opens to such a degree as to induce initial practical fuel feeding operation of main fuel supply line ML' of the secondary fuel supply system 34, the secondary throttle switch 108 issues the second signal for causing, via the control unit 106, the two-way valve 112 to take another position, connecting the passage 114 with the third auxiliary passage 102. Thus, similar to the case of the first embodiment, the main fuel supply line ML' of the secondary fuel supply system 34 is subjected to the feedback control.

As is understood from the above, according to the present invention, the feedback control is precisely achieved throughout whole operation modes from a low load operation to a high load operation of the engine. Thus, the drawback of the conventional system in that the air-fuel mixture becomes richer than stoichiometric when the secondary fuel supply system operates is solved. Thus, the three-way catalytic converter in the exhaust system exhibits its maximum function throughout the whole operation modes of the engine.

What is claimed is:

1. In an internal combustion engine having at its intake section a two-barrel type carburetor including a primary fuel supply system having a primary main fuel supply line and a primary slow fuel supply line and a secondary fuel supply system having a secondary main fuel supply line and a secondary step fuel supply line, and at its exhaust section a three-way catalytic converter disposed in an exhaust tube of said engine, a closed loop type air-fuel ratio control system comprising:

an exhaust gas sensor for producing an information signal representative of the air-fuel ratio of the engine inlet mixture by sensing the engine exhaust gas;

a control unit for producing a command signal by processing said information signal issued from said exhaust gas sensor;

first means for controlling the amount of air fed to said primary main fuel supply line in accordance with the command signal from said control unit;

second means having first and second conditions which take place selectively, said first condition being a condition wherein said second means controls the amount of air fed to said primary slow fuel supply line in accordance with the command signal from said control unit, said second condition being a condition wherein said second means controls the amount of air fed to either of said secondary main fuel supply line and said secondary step fuel supply line in accordance with the command signal from said control unit, and third means for causing said second means to assume selectively said first and second conditions in accordance with the load applied to the engine.

2. A closed loop type air-fuel ratio control system as claimed in claim 1, in which said first means comprises:

a first conduit means extending from said primary main fuel supply line for introducing air into said line;

a first electromagnetic valve disposed in said first conduit means and electrically connected to said control unit to control the air flow rate in the first conduit means in response to the command signal from the control unit; and a vacuum operated air flow rate controller disposed in said first conduit means for controlling the flow rate of air in said first conduit means in accordance with the negative pressure created in the primary barrel of the carburetor.

3. A closed loop type air-fuel ratio control system as claimed in claim 1 or 2, in which said second means comprises:

a second conduit means extending from said primary slow fuel supply line for introducing air into said line;

a second electromagnetic valve disposed in said second conduit means and electrically connected to said control unit to control the air flow rate in said second conduit means in response to the command signal from the control unit;

a third conduit means having one end connected to said second conduit means at a portion downstream of said second electromagnetic valve and the other end connected to said secondary main fuel supply line;

a third electromagnetic valve disposed in said third conduit means and electrically connected to said control unit to selectively open and close the third conduit means in response to the command signal from said control unit; and a fourth electromagnetic valve associated with said primary slow fuel supply line and electrically connected to said control unit to selectively open and close said line, while permitting air introduction into the same, in response to the command signal from said control unit.

4. A closed loop type air-fuel ratio control system as claimed in claim 3, in which said third means comprises:

a primary throttle switch electrically connected to said control unit and issuing respectively different information signals when the primary throttle valve of said primary fuel supply system is fully closed and open;

a secondary throttle switch electrically connected to said control unit and issuing another information signal when said secondary throttle valve of said secondary fuel supply system opens by a predetermined degree.

5. A closed loop type air-fuel ratio control system as claimed in claim 3, in which said second means further comprises:

a fourth conduit means having one end connected to said third conduit means at a portion downstream of said third electromagnetic valve and the other end connected to the secondary step fuel supply line; and an electromagnetic two-way valve arranged in the portion where said fourth conduit means is united with said third conduit means, said two-way valve being electrically connected to said control unit to change the air flow into the secondary main fuel supply line to that into the secondary step fuel supply line or, vice versa, in response to the command signal from said control unit.

6. A closed loop type air-fuel ratio control system as claimed in claim 5, in which said secondary throttle switch of said third means issues a still another information signal, when said secondary throttle valve opens beyond said predetermined degree, to permit, via said control unit, said two-way valve to take the position to introduce the air into said secondary main fuel supply line.

* * * * *